US011808535B2

(12) United States Patent
Shawver et al.

(10) Patent No.: US 11,808,535 B2
(45) Date of Patent: Nov. 7, 2023

(54) HIGH PRESSURE NOZZLE AND RELATED METHODS

(71) Applicant: PSI Pressure Systems LLC, Baytown, TX (US)

(72) Inventors: Todd A. Shawver, Battle Creek, MI (US); Jamie A. Forrest, Commerce Township, MI (US)

(73) Assignee: PSI Pressure Systems LLC, Baytown, TX (US)

( * ) Notice: Subject to any disclaimer, the term of this patent is extended or adjusted under 35 U.S.C. 154(b) by 658 days.

(21) Appl. No.: 16/932,216

(22) Filed: Jul. 17, 2020

(65) Prior Publication Data

US 2021/0025664 A1 Jan. 28, 2021

Related U.S. Application Data

(60) Provisional application No. 62/878,916, filed on Jul. 26, 2019.

(51) Int. Cl.

| | |
|---|---|
| ***B05B 1/14*** | (2006.01) |
| ***B05B 3/06*** | (2006.01) |
| ***B05B 13/06*** | (2006.01) |
| ***B05B 15/14*** | (2018.01) |
| ***F28G 3/16*** | (2006.01) |

(52) U.S. Cl.

CPC ..... *F28G 3/163* (2013.01); *B05B 3/06* (2013.01); *B05B 13/0636* (2013.01); *B05B 15/14* (2018.02); *B05B 1/14* (2013.01)

(58) Field of Classification Search

None

See application file for complete search history.

(56) References Cited

U.S. PATENT DOCUMENTS

| | | | | |
|---|---|---|---|---|
| 3,269,659 | A | 8/1966 | Shelton et al. | |
| 7,635,096 | B2 | 12/2009 | Wright et al. | |
| 8,006,920 | B2 | 8/2011 | Wright et al. | |
| 8,016,210 | B2 | 9/2011 | Wright | |
| 8,057,607 | B2 | 11/2011 | Gardner et al. | |
| 8,192,559 | B2 | 6/2012 | Garman | |
| 8,220,724 | B2 | 7/2012 | Wright | |
| 8,434,696 | B2 | 5/2013 | Wright | |
| 8,668,155 | B2 | 3/2014 | Wright | |
| 2010/0025492 | A1* | 2/2010 | Wright | B05B 3/06 239/258 |
| 2016/0243597 | A1 | 8/2016 | Shawver | |

* cited by examiner

*Primary Examiner* — Levon J Shahinian

(74) *Attorney, Agent, or Firm* — Warner Norcross + Judd LLP

(57) ABSTRACT

A high pressure nozzle adapted to clean a tube includes an elongated body having a proximal end and a distal end, and defines one or more elongated channels along an exterior, extending from the distal end to the proximal end, and includes a head rotatably mounted to the body adjacent the distal end. The head includes jets that expel liquid at a pressure of at least 1000 psi to clean material from a wall of a tube and/or rotate the head relative to the body about a longitudinal axis. The channels are operable in an evacuation mode in which a portion of liquid is conveyed through the channels away from the head toward the proximal end to prevent and/or impair hydraulicing of the nozzle in the tube when the nozzle encounters a blockage within the tube. Related methods of use of the nozzle also are provided.

13 Claims, 7 Drawing Sheets

HIGH PRESSURE NOZZLE AND RELATED METHODS

BACKGROUND OF THE INVENTION

The present invention relates to water blasting equipment and more particularly to high pressure water blasting devices adapted to clean equipment such as heat exchangers, falling pressure evaporators, storage tanks, tubes, piping, towers and similar equipment.

There are a variety of industrial piping systems using in conjunction with different industries, such as chemical processing, recycling, polymer forming, oil and gas refining and other industries. These industrial piping systems frequently require cleaning, resurfacing, painting and/or coating. As an example, in the oil refining industry, special equipment such as heat exchangers and evaporators are utilized. Over time, the bores and exterior walls of the heat exchanger's tubes can corrode, scale or develop excessive residue and buildup. This buildup and/or residue can decrease the efficiency of heat transfer through the heat exchanger. In turn, operating costs for the heat exchanger can significantly increase.

Accordingly, the cleaning of such equipment has spawned an industry. Some manufacturers make water blasting equipment that operates at high pressures, greater than 10,000 psi in some cases, to effectively blast or remove the scale, residue, corrosion, etc. from equipment. In the case of heat exchangers, special equipment has been developed. This equipment includes a small diameter lance or hose having a special nozzle that can be inserted into individual heat exchanger tubes for blasting. Water is pumped at high pressure through the lance or hose to the nozzle, which forces the water out of a head at high pressure toward a sidewall or debris in front of the nozzle of the tube to blast off residue, build-up and other material from the sidewall of the tube.

Many lance, hose and nozzle constructions are hand held and manually operated by a human operator. To advance the nozzle and clean a tube, the operator holds a portion of the lance in their hands and pushes it and the nozzle through the tube to clean its interior. Such advancing occurs while the head of the nozzle is expelling jet streams of liquid at extremely high pressures as the head moves through the tube.

In such a cleaning application, there can be inherent dangers. For example, as a lance or hose and its nozzle are advanced, the nozzle can encounter constricted portions of the tube where material has built up excessively. In some cases, the tube can be blocked completely. When a nozzle encounters such blockages (which may or not be a full blockage), the high pressure jet streams exiting the head might not be strong enough to loosen the blockage. Those jet streams, however, produce a propulsion force or back force that can propel the nozzle and thus the lance away from the blockage, which action sometimes is referred to as hydraulicing or bulleting. The lance and nozzle thus can be launched, very much like a missile, at extremely high speeds, back toward the user through the tube. If the user is not paying attention or loses grip, the lance and nozzle will rip through the user's hands at extremely high speeds.

In such a case, the lance or nozzle potentially can injure the user's hands and arms. If the nozzle whips as it exits the tube near the user, the lance or nozzle can strike the user's body or head, causing significant injury or death. In some cases, when the nozzle passes through the user's hands, if there is a laceration on the user's hands, the high pressure jetted water can enter the user's tissue through the laceration. The high pressure expands the tissue, muscle and skin, and can cause even further injury to the user. In all of the above cases, there is an issue with the water blasting lances being handled manually by the users. There can be a propensity for accidents to occur when those devices unintentionally encounter a blockage in a tube and undergo hydraulicing.

While many lance and nozzle manufacturers have attempted to increase the safety afforded to the users of these devices, there remains room for improvement with regard to preventing hydraulicing events and improving safety.

SUMMARY OF THE INVENTION

A tube cleaning apparatus and related method are provided to enhance the safety of operators engaged in cleaning elongated tubes of certain equipment.

In one embodiment, the apparatus can include a nozzle having a nozzle body, a shaft, a head attached to the shaft and one or more jets in the head, where the body defines one or more channels from a distal end near the head to a proximal end near a user, the channels being sized and shaped to allow high pressure liquid to evacuate away from the head when the nozzle is in a tube to prevent and/or reduce the likelihood of hydraulicing.

In another embodiment, the nozzle head can be rotatably mounted to the body adjacent the distal end. The head can include jets that expel liquid at a pressure of at least 1000 psi to clean material from a wall of a tube and rotate the head relative to the body about a longitudinal axis.

In still another embodiment, the nozzle and channels are operable in an evacuation mode in which a portion of liquid is conveyed through the channels away from the head toward the proximal end to prevent and/or impair hydraulicing of the nozzle in the tube when the nozzle encounters a blockage within the tube.

In yet another embodiment, the body includes a first housing near the distal end and a second housing near the proximal end. These housings can be connected via a threaded connection. One or more of the channels can be radially displaced outward from the longitudinal axis from the threaded connection. The threads of the threaded connection can alternatively be located inward from the channels, but outward from an internal conduit that transfers high pressure liquid from the proximal end, toward the distal end, through the body.

In even another embodiment, each of the channels can include a bottom wall. The body can have a first thickness between the threads and the bottom wall and a second thickness between the threads and the exterior surface of the body. The second thickness can be greater than the first thickness.

In a further embodiment, the first housing can define the channels in a first portion extending to a first intermediate edge. These can be first channel parts. The second housing can define continuations of the channels, or second channel parts, from a second intermediate end immediately adjacent the first intermediate end, to the proximal end of the body. The first and second housings can be joined with threads that are clocked to align the channels in the first housing and the continuations of the channels in the second housing.

In still a further embodiment, the first housing can include first internal threads that are disposed over a portion of external threads on the second housing. The first housing can define the channels to the first intermediate end. The second housing does not define the continuations of the channels in the portion having the external threads, but does define the continuations of the channels from the second intermediate end to the proximal end of the body. The bottom walls of the channels can be disposed radially outward from the threads of the first housing, which can be disposed radially outward from the threads of the second housing, which can be disposed radially outward from an internal conduit of the body.

In even a further embodiment, a method of cleaning a tube is provided. The method can include advancing the nozzle axially within an elongated tube in a first direction toward a distal end of the tube and away from a proximal end of the tube; ejecting a liquid from the head through one or more jets into the tube at a pressure of at least 1000 psi to thereby rotate the head relative to the body about a longitudinal axis; removing material from a sidewall of the tube; and evacuating the material with a portion of the liquid away from the head and rearward toward the proximal end of the tube through a channel defined by an exterior surface of the body. The portion of liquid can flow in the channel, as well as between the exterior surface and the sidewall of the tube. The evacuation of the portion of liquid and material through the channel can prevent and/or impair hydraulicing of the nozzle in the tube to thereby provide a safe operating environment for the user.

In another, further embodiment, the method can include advancing the nozzle past a face plate of a heat exchanger within which the elongated tube is disposed; encountering a blockage in the tube with the nozzle; and evacuating enough of the portion of liquid through the channel so that the amount of force produced by the liquid exiting the jet impairs the propulsion of the nozzle backward, toward the face plate of the heat exchanger, adjacent a location where a user engages a lance joined with the nozzle.

In still another, further embodiment, the method can be used to remove a material from the tube that is a byproduct of an oil refining process. The face plate can be adjacent a plurality of additional elongated tubes. The method can include removing the nozzle from the elongated tube, the nozzle passing the face plate during the removing step; inserting the nozzle into a second elongated tube of the additional elongated tubes; and advancing the nozzle in the second elongated tube until the nozzle exits a distal end of the second elongated tube. This process can be repeated multiple times to clean multiple tubes in the heat exchanger until the heat exchanger is satisfactorily cleaned and ready to be put back in commission.

In even another further embodiment, the method can include conveying the liquid through the body toward the head in a first direction through a conduit located radially inward from the channel; and conveying the portion of the liquid away from the head in a second direction opposite the first through the first channel, inward from the exterior surface of the body.

With the current embodiments of the tube cleaning apparatus and method, improved levels of safety for operators can be realized. Where the channels are included in the body of the nozzle, the nozzle can efficiently remove material blasted from the tube sidewall and move it toward the distal end of the tube as well as the proximal end of the tube. Where the nozzle encounters a blockage of material in the tube, the channels can evacuate liquid under high pressure through the channels rather than allow that liquid to build up too much pressure to cause the nozzle to hydraulic and forcefully propel the nozzle away from the blockage toward a user of the cleaning apparatus. In turn, the probability that the user will encounter a potentially dangerous hydraulicing event is reduced in many cases. This can improve the overall safety of operation of the cleaning apparatus.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A tube cleaning apparatus and related method in accordance with the current embodiment is illustrated in FIGS. 1-5 and generally designated 10. The apparatus optionally can be used to clean one or more elongated tubes, generally removing residue, debris, condensate, sludge, buildup, or other substances (all referred to as materials herein) from a respective tube as the apparatus is advanced in the tube. The apparatus can be modified to be used in conjunction with cleaning a variety of equipment, such as piping or conduits of equipment in various industries. Optionally, the apparatus can be used to high pressure blast or clean falling pressure evaporators, towers, piping, containers, bins, molds, impellers, mining equipment, watercraft and a variety of other equipment. Thus, the current embodiments are not limited to equipment associated with cleaning tubes of heat exchangers used in the oil and gas industry, although that is what is primarily illustrated in the current embodiment.

Figure 2:
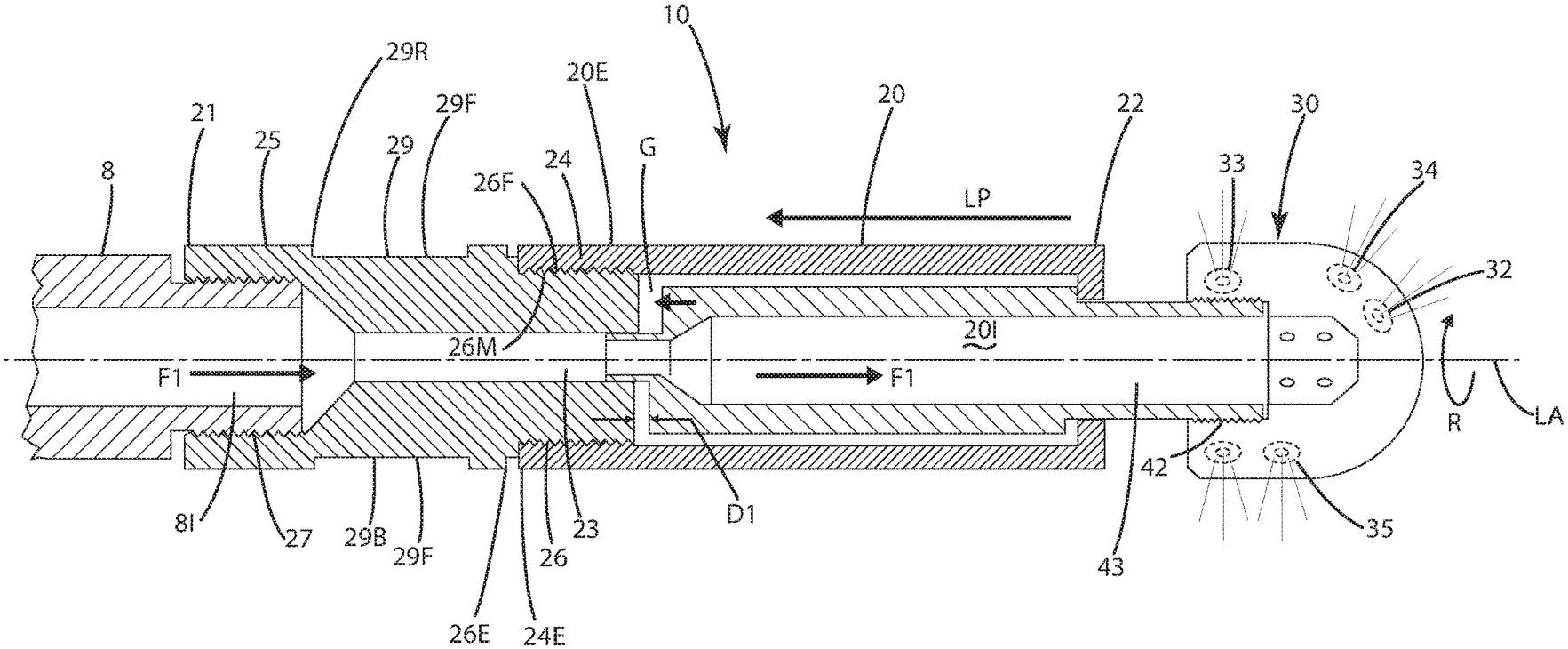
FIG. 2 is a section view of the nozzle taken along line II-II of FIG. 1.
Figure 4:
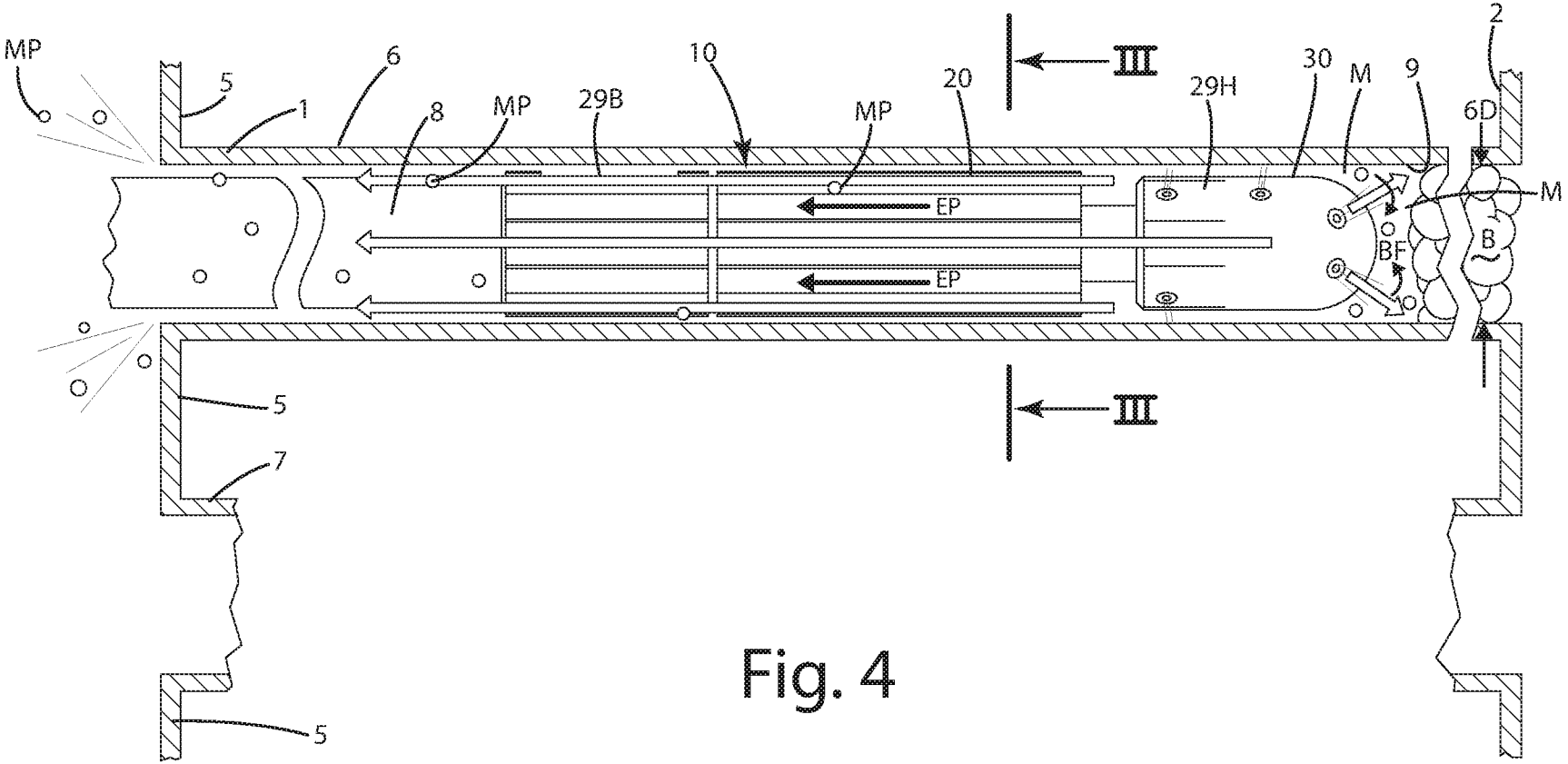
FIG. 4 is a view of the nozzle encountering a blockage in a tube and operating in an evacuation mode to prevent and/or impair hydraulicing of the nozzle.
Figure 5:
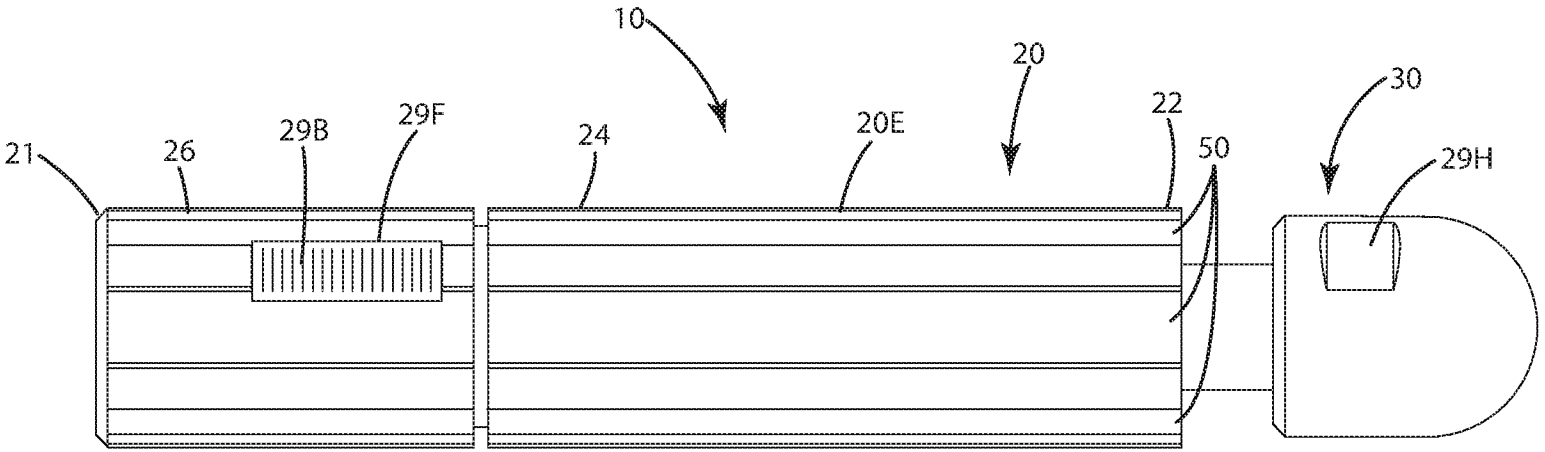
FIG. 5 is a side view of the nozzle.

As shown in FIG. 2, the cleaning apparatus is in the form of a nozzle 10 that can be attached to an elongated lance 8. A high pressure water pump or other source of liquid (not shown) can be coupled to the lance 8 and/or nozzle 10 or otherwise in fluid communication with the same. The lance 8 can be the same length or longer than the tube 6 to be cleaned so that a human operator or user can push the lance and nozzle completely though the tube 6, from a proximal tube end 1 near the user, to a distal tube end 2, far away from the user, as shown in FIG. 4. As also shown there, the tube 6 can be part of an array of tubes in a heat exchanger having additional adjacent tubes 7 that can be cleaned in succession by a user manipulating the lanced and the nozzle, moving the same from one tube 6 to the next tube 7. When moved, the lance and nozzle pass through and out from the face plate 5 of the heat exchanger multiple times, in cleaning the individual tubes in the array of tubes in the heat exchanger. In many cases, the lance and nozzle can be manually fed into the tube 6 by a user, being physically pushed into that tube. In other cases, the lance and nozzle can be mounted to a drive mechanism (not shown) that automatically feeds the lance and nozzle through the tube. Examples of different types of drive mechanisms are illustrated in U.S. Pat. No. 3,269,659 to Shelton, as well as U.S. Pat. No. 8,192,559 to Garman, both of which are incorporated by reference in their entirety.

As mentioned above, the nozzle 10 can be attached to the lance 8 or a gun, and can further be in fluid communication with a liquid source configured to deliver liquid to the nozzle, and subsequently eject the liquid from a jet of the nozzle or the head in general, at a pressure optionally of at least 1,000 psi, at least 5,000 psi, at least 10,000 psi, at least 15,000 psi, at least 20,000 psi, or at least 40,000 psi, or up to 100,000 psi.

The components of the nozzle 10 will now be described in detail with reference to FIGS. 1-4. To begin, the nozzle 10 can include an elongated body 20 including a proximal end 21 and a distal end 22. The body and nozzle can include a longitudinal axis LA that also can serve as an axis of rotation for the head 30 that is rotatably mounted to the body 20. The head 30 optionally can be joined with a support shaft 40 that projects into an interior 201 of the elongated body 20.

Figure 1:
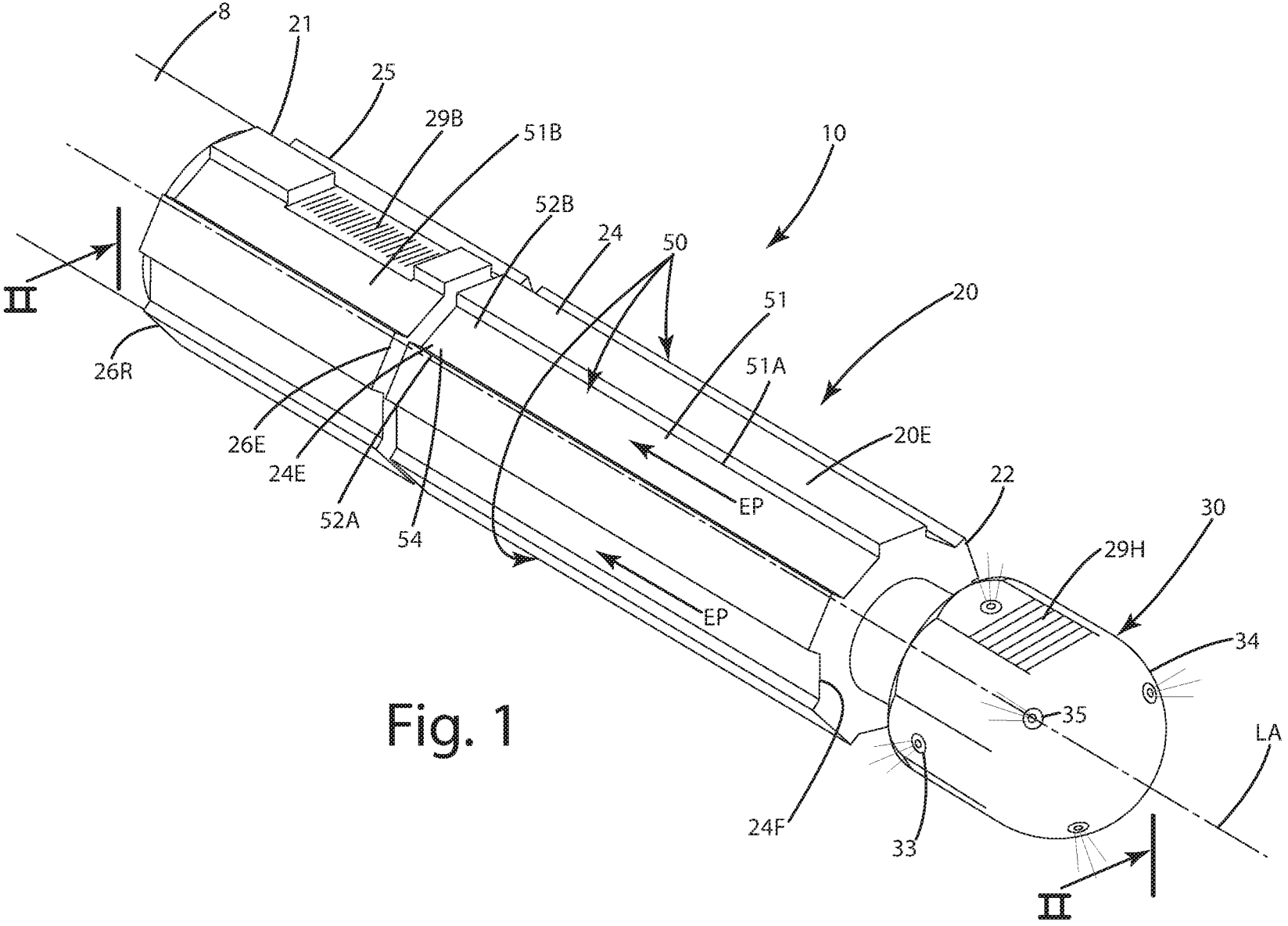
FIG. 1 is a perspective view of a tube cleaning apparatus of a current embodiment in the form of high pressure nozzle including a body and a rotatable head, the body defining multiple elongated evacuation channels.

The head 30, as shown in FIGS. 1 and 2 can expel liquid therefrom and out into the environment, optionally against an interior diameter, tube wall and/or material coating, deposited on, or otherwise engaged with the sidewall 9 of the tube 6 as described below. The head can include one or more jets, which optionally can include a rotator jet 32 which is configured to expel liquid therefrom at high pressures, for example, at least 1000 psi or the other pressures mentioned above, to thereby impart rotation to the head 30. As a result, the head can rotate in direction R relative to the body 20 and the other components of the system as well as the interior of the tube within which the nozzle 10 is located. The jets optionally can include one or more thruster jets 33, which can expel liquid so the liquid exits the same extremely high pressures, for example, at least 1000 psi or at least 5000 psi, or the other pressures noted above. As a result, these thruster jets 33 can assist in propelling the nozzle 10 through a tube, generally away from a proximal end 1 toward a distal end 2 of the tube 6. The thruster jets 33 also can assist in evacuating or otherwise moving a portion of liquid and material MP removed from the tube 6 rearward, toward the proximal end 21 of the nozzle and generally toward the proximal end 1 of the tube as described below. The thruster jets 33 can thrust the material MP and portion of liquid rearward, away from the head with the liquid flowing out of the thruster jets.

As shown in FIG. 2, the jets optionally can include one or more cutter jets 34 that generally face forward relative to the head and that face forward along the longitudinal axis LA of the nozzle. The cutter jets 34 can assist in expelling high pressure liquid onto the tube interior sidewall and toward material M on that interior sidewall to lift the material M off from the tube to produce freed material MP. These cutter jets 34 can initially and/or fully remove material M from the sidewall 9 of the tube due to the high pressure liquid propelled and expelled through the jets. The cutter jets also can propel the freed material MP and liquid under pressure forwardly, away from the head 30 and toward the distal end 2 of the tube 6. Further optionally, the jets can include one or more polisher jets 35, which generally face outward and optionally perpendicular to the longitudinal axis LA. These polisher jets 35 can further remove the material loosened or broken up by the cutter jets. They also can assist in polishing the surface of the sidewall 9 of the tube 6.

As shown in FIG. 2, the head 30 can be attached via the support shaft 42 to the body 20. The head 30 and shaft 40 can be attached via a threaded connection 42, or some other connection. The shaft 40 can define an internal conduit 43 that leads from the head into the body 20. This internal conduit 43 can convey high pressure liquid from the body to the head, while the shaft and/or head rotates relative to the body, optionally under forces generated by liquid being expelled from the rotator jet 32. Optionally, the shaft 40 can be configured to retract a distance D1 into the body 20. This can be accomplished via a small gap G being disposed between the shaft 40 and a portion of the body 20. Accordingly, when the head 30 encounters a blockage, it can retract slightly toward the body 20 to provide some give. Of course, this feature can be absent, and the shaft can be fixed and non-movable along the longitudinal axis LA.

The internal conduit 43 of the shaft can be in fluid communication and form a portion of an internal conduit 23 of the body 20. The internal conduit 23 can further be in communication with an inlet 81 which is associated with, and in fluid communication with the lance 8 that delivers the high pressure liquid to the nozzle 10. The high pressure liquid can flow in direction F1 through the lance, through the internal conduit 23, through the conduit 43 and to the respective jets of the head 30.

The body 20 can include a first housing 24 and a second housing 25 as shown in FIG. 2. Both of these housings can define a portion of the internal conduit 23. One or both of these housings can define the interior 201 of the body 20. One or both of these housings can house and otherwise engage the shaft 40. The first and second housings 24 and 25 can be joined in a variety of manners. For example, the housings can be joined such that the shaft 40 can be inserted into the interior 201 of the body 20, without the head attached. The head can be attached after the threaded connection 42 protrudes from the body 20. The second housing 25 can be joined with the first housing 24 to secure the shaft 40 in the body 20.

Figure 3:
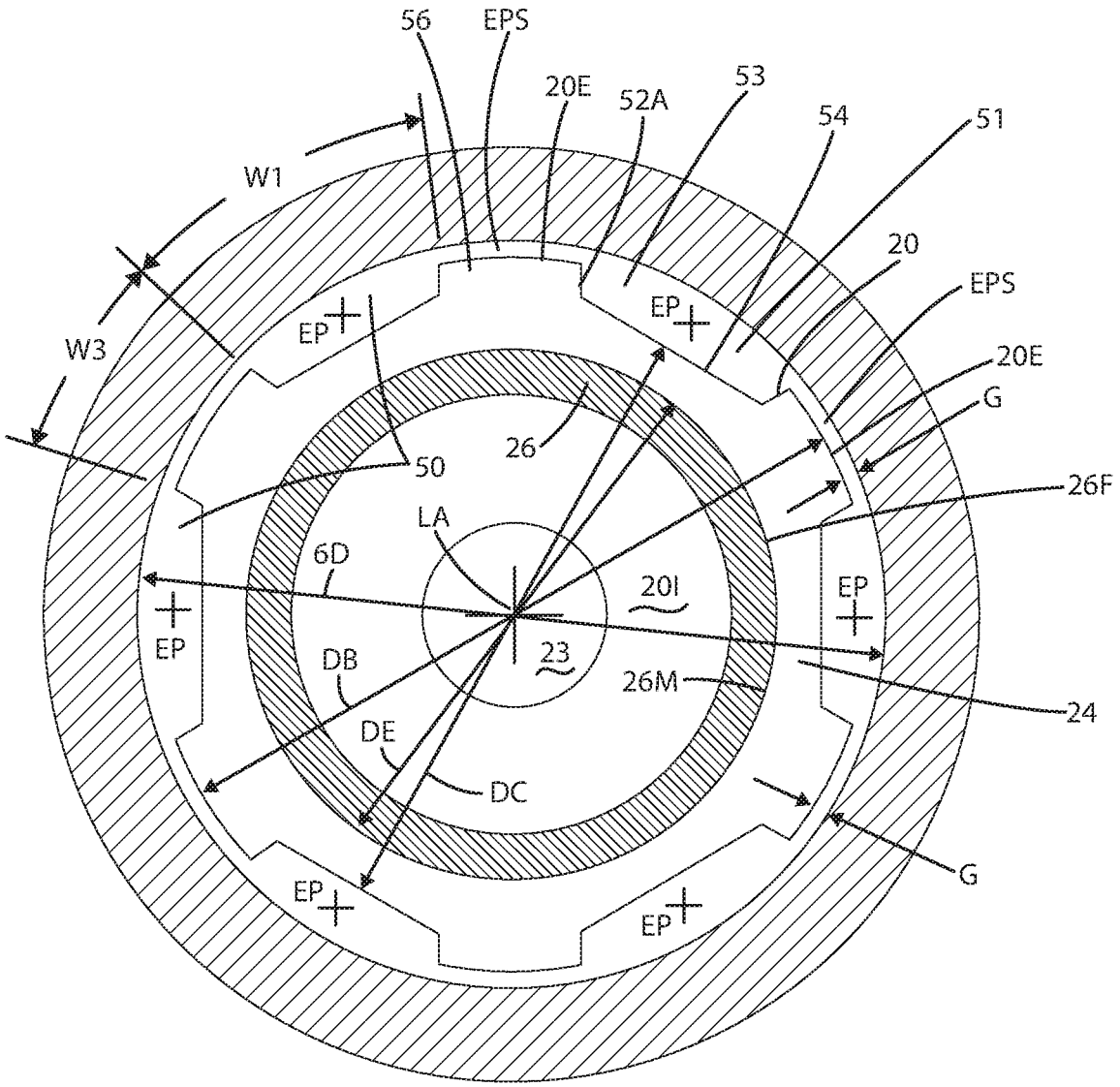
FIG. 3 is a section view of the nozzle taken along line III-III of FIG. 4.

As illustrated in FIGS. 2 and 3, the first and second housings 24 and 25 can be joined via a threaded connection 26. This threaded connection 26 can include male and female threads. For example, threaded connection 26 can include a male threaded part 26M and a female threaded part 26F. As shown, the male part 26M can be associated with the second housing, and the female threaded part 26F can be associated with the first housing 24. Of course, these threads can be reversed. The female threaded part 26F can include threads on an interior portion. These female threads 26F can be disposed opposite a portion of the exterior surface 20E of the body 20. The female threaded part 26F can include both the female threads 26F on the interior 201 as well as a portion of the surface 20E of the body 20. The male threaded part and male threads 26M can be disposed inwardly, closer to the longitudinal axis LA, than both the female threads 26F and the exterior surface 20E of the body 20 at this threaded location 26.

With reference to FIG. 2, the first housing 24 is joined with and secured to the second housing 25. The second housing 25 can include another threaded connection to secure the second housing 25 and generally the nozzle 10 to the lance 8. Of course, this threaded connection can be similar to the threaded connection 26, with male and female threaded portions. In other cases, the connection between the second housing 25 and the lance 8 can be altered to include some other type of connection rather than a threaded connection.

The body 20 and head 30 optionally can be outfitted with one or more tool lands 29B and 29H respectively. These tool lands can be flat planar surfaces having a surface area sufficient to engage a box end tool. The tool can be manipulated so that respective portions of the head and/or body can be rotated relative to one another to assemble or disassemble the nozzle. The flat planar surfaces 29F can be disposed on diametrically opposite sides of the longitudinal axis LA. These flat planar surfaces 29F can be substantially parallel to one another on opposite sides of the longitudinal axis. Accordingly, a tool, such as a box end wrench, can engage these flat planar surfaces 29F, and the lands in general, to impart rotation of one component of the nozzle relative to another. In turn, the tool can assemble or disassemble the same via rotation of the components relative to one another to connect or disconnect them at their threaded connections. These lands 29B and the flat planar surfaces 29F are oriented perpendicular to the longitudinal axis LA of the nozzle 10. As shown in FIG. 2, these types of lands do not assist in conveying liquid rearward away from the head and the distal end 22 to the proximal end 21 of the nozzle 20. Indeed, in some cases, the rearward most sidewalls, for example, 29R of the land 29B, can be directly transverse to and/or perpendicular to the liquid path LP of liquid that is expelled from the head 30. As such, these lands are not configured or designed to convey water or other liquid from the distal end 22 to the proximal end 21 of the nozzle 10.

As shown in FIGS. 1-5, the nozzle can include multiple elongated channels 50 defined by the exterior surface 20E of the body 20. The channels 50 can be defined by the body alone, and not the head 30. These channels 50 can be oriented substantially parallel to the longitudinal axis LA of the nozzle, and can extend from the distal end 22 to the proximal end 21 of the body 20. The channels 50 can be configured to convey a portion of the liquid from the head 30, generally expelled from the jets, and generally from the distal end 22 toward the proximal end 21 of the body while the liquid is conveyed under high pressure to the head 30 and expelled from the jets. Generally, the channels 50 can also convey portion of the liquid from the distal end 22 toward the proximal end 21 while liquid simultaneously is conveyed in the internal conduits, for example, 23 and 43, and in an opposite direction F1.

As shown in comparing FIGS. 1 and 2, the liquid under pressure flows in direction F1 through the internal conduits 23 and 43 to the head 30 where it is expelled by the respective jets. When the nozzle 10 is in a tube 6, and the channels 50 are operated in an evacuation mode as described below, a portion of the liquid is conveyed along an evacuation path or flow path direction EP, which head, in a direction, is opposite the direction of flow path F1, along the elongated channels, away from the head 30 toward the proximal end 21 from the distal end 22.

The channels 50 can operate in this evacuation mode to convey a portion of the liquid expelled from the head generally away from distal end 22 toward the proximal end 21 and thus along the lance and out a proximal end 1 of a respective tube when the nozzle is in use. In this evacuation mode, where the portion of liquid travels along the evacuation path or in the direction EP, that portion of liquid also can evacuate and move the removed material MP from the tube as shown in FIG. 4. When this removed material moves rearward, toward the proximal end 21, this can offer additional cleaning capabilities and efficiencies of the nozzle 10. As an example, with the channels 50 of the current embodiment, the material can be removed both forwardly, toward the distal end 2 of the tube, as well as rearwardly, toward the proximal end 1 of the tube.

The channels also or alternatively can be operable in the evacuation mode to prevent and/or impair hydraulicing of the nozzle in the tube when the nozzle encounters a blockage B in the tube 6 as illustrated in FIG. 4. As shown, the tube 6 encounters a blockage B that blocks or closes off a substantial portion of the tube internal diameter 6D. This blockage B can block optionally at least 50%, at least 60%, at least 70%, at least 80%, at least 90%, or 100% of the diameter 6D and the associated cross section of the tube. With such a blockage B, liquid expelled from the jets of the head 30 typically cannot be propelled or flow forward, toward the distal end 2 of the tube 6. As a result, that liquid expelled from the head engages the blockage B, and creates a back pressure force BF on the nozzle 10. In some cases, the back pressure force BF can be optionally at least 100 pounds, at least 250 pounds, at least 500 pounds, at least 1000 pounds or more, depending on the pressure of liquid expelled from the head.

In the case of conventional nozzles, unlike the current embodiments, this back pressure force can push the nozzle away from the distal end 2, toward the proximal end 1, at significant velocity and under significant acceleration. This action of the nozzle 10 being forcibly pushed toward an end of the tube under the pressure and forces created by liquid expelled from the head and jets is referred to as hydraulicing or bulleting of the nozzle. When the nozzle undergoes hydraulicing or bulleting, the nozzle 10 and lance 8 can be shot rearward, out of the proximal end 1 of the tube at significant velocities. This can result in a user being surprised or worse yet injured due to the lance and nozzle ripping through their hands.

With the current embodiment, however, the back pressure force BF can be significantly reduced, in some cases by optionally up to 10%, up to 25%, up to 50%, up to 75% or up to 90% or more. This can be achieved via the high pressure liquid being evacuated away from the head 30 generally in the direction from the distal end 22 toward the proximal end 21 of the body 20 along an evacuation path or flow direction EP in the channels 50. With this portion of liquid being conveyed through the channels 50, hydraulicing of the nozzle when the nozzle encounters a blockage B can be prevented and/or impaired. As an example, the nozzle is not propelled away from the blockage or otherwise toward the proximal end with a force optionally greater than 25 pounds, greater than 50 pounds, greater than 75 pounds, greater than 100 pounds, greater than 125 pounds, greater than 150 pounds, greater than 175 pounds, greater than 200 pounds, greater than 250 pounds, or less than 100 pounds. Accordingly, a user can maintain a grip on the lance 8 and control the nozzle 10 to keep it in the tube 6, rather than hydraulicing or bulleting back toward the user, out of the tube 6. In some cases, the hydraulicing can be impaired such that the nozzle is still propelled away from the blockage B, in some cases, out the proximal end 1 of the tube, but at lower speeds and under lower forces as compared to constructions where the channels 50 are not present and/or not operating in an evacuation mode.

As shown in FIGS. 1-3, the channels 50 can be disposed around the longitudinal axis LA. An exemplary channel is first channel 51 which can be similar to all the other channels 50. The first channel 51 can include a first channel sidewall 52A and a second channel sidewall 52B. Each of these sidewalls can transition to the first exterior surface 20E of the body 20, which can generally form the outermost surface of the body. The channel wall can be considered to be disposed inward from the exterior surface of the body. The sidewalls 52A and 52B can be generally planar as illustrated and can transition to a bottom wall 54. The bottom wall 54 can be substantially planar as illustrated. Each of the channels, as well as the respective sidewalls and bottom can extend substantially the entire length of the body, and can be traverse the first and second housings.

The exterior surface 20E adjacent the sidewalls can be substantially cylindrical, save for the material removed to define the channels 50. Each channel can be separated from an adjacent channel by a buttress 56, which can include the sidewalls of adjacent channels. Optionally, each channel 50 can include a width W1, which can be greater than the width W3 of each of the respective buttresses. Of course, the widths of the channels can vary relative to the width of the buttresses depending on the number of channels and their location. Optionally, the width W1 of the channel can be expressed as a ratio relative to the diameter DB of the body 20. For example, the ratio of the channel width W1 to the diameter DB can be optionally less than 1:2, less than 1:3 less than 1:4, less than 1:5 or less than 1:5, expressed as W1:DB. As shown, there can be six channels disposed around the longitudinal axis LA of the body and nozzle. Of course, there can be more or fewer channels defined in the exterior surface of the body, depending on the size of the nozzle, the application and the intended evacuation of liquid and removed material.

Figure 6:
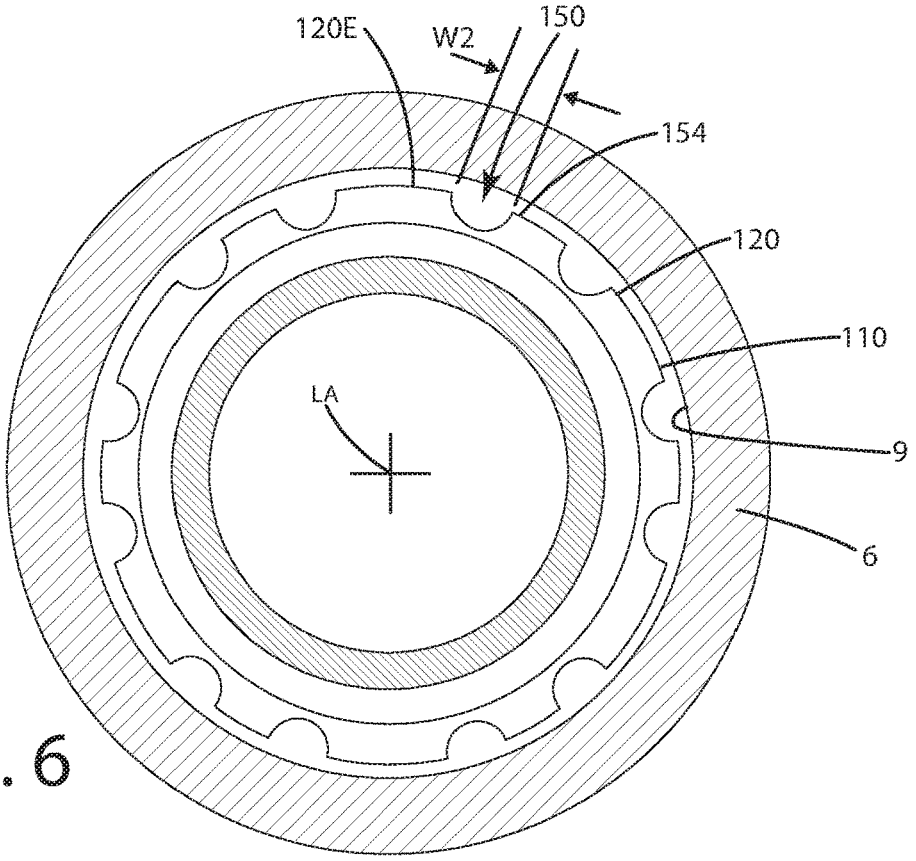
FIG. 6 is a section view of a first alternative embodiment of the nozzle taken along line III-III of FIG. 4.
Figure 7:
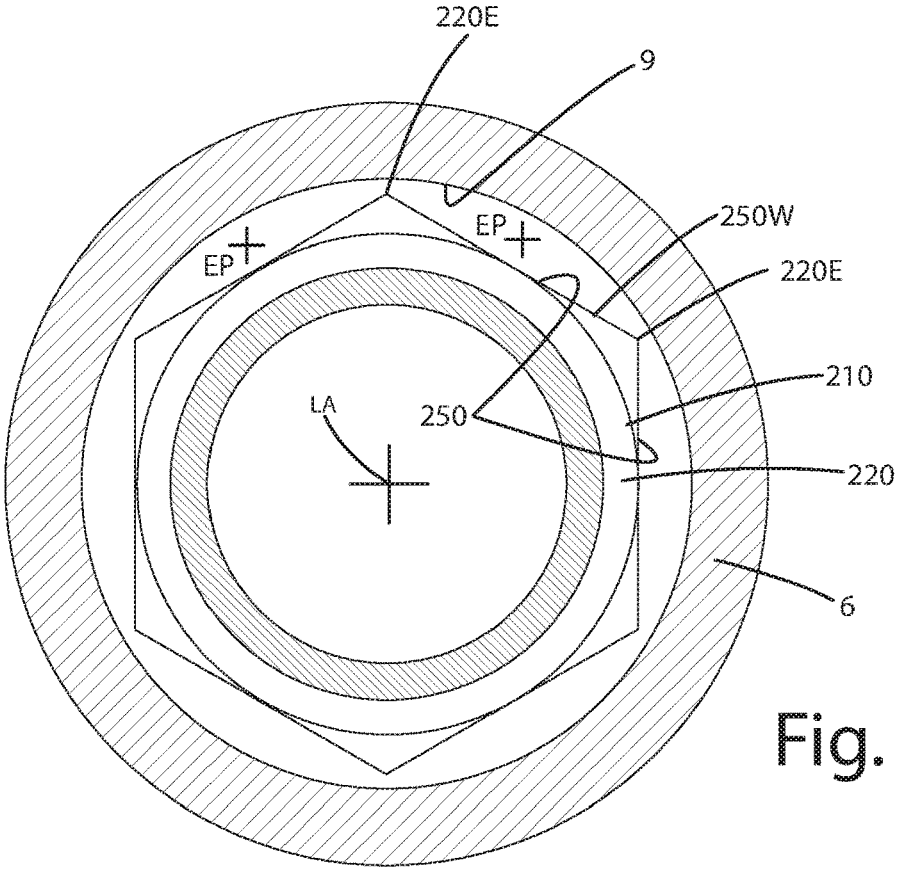
FIG. 7 is a section view of a second alternative embodiment of the nozzle taken along line III-III of FIG. 4.

In some cases, the channels 50 can be structured somewhat differently. For example, in the first alternative embodiment shown in FIG. 6, the channels 150 can be in the form of concave grooves that extend along the exterior surface of the body 120 of the nozzle 110. The grooves can be circular and/or otherwise rounded from where they transition to the exterior 120E to the bottom 154 of each of the grooves. The sidewalls can transition upward from the bottom 154 to the exterior surface 120E in a continuous and rounded manner such that the bottom and sidewalls are contiguous. There also can be more such concave channels 150 because the width W2 of the channels is rather small compared to the diameter of the body 120. Each of these respective channels can include one or more channel walls that extend longitudinally along the longitudinal axis LA. The channel walls can be disposed radially inward from the exterior surface of the body. The channel wall can be considered to be disposed inward from the exterior surface of the body. As another example, a second alternative embodiment, shown in FIG. 7, includes a nozzle 210 having channels 250 defined by the body 220 that are generally flat planar lands disposed about the longitudinal axis LA. These lands can be engaged by a tool to rotate components during assembly or disassembly. These flat, planar lands effectively extend between the outermost exterior surfaces 220E of the body 220. These exterior surfaces 220E effectively form points or corners at which adjacent channels or lands 250 transition to one another. Although referred to as flat planar lands, these elements 250 also can be referred to as channels including a bottom or sidewall, which is the flat surface 250W of the land. The channels 250 also operate in evacuation mode similar to the other embodiments herein, with the flow of a portion of liquid flowing along the evacuation path EP, generally between the wall 250W of the channel or land and the sidewall 9 of the tube 6. The channel wall 250W can extend longitudinally along the length of the body 220, and along the longitudinal axis, optionally parallel to that longitudinal axis LA. The channel wall can be considered to be disposed inward from the exterior surface of the body.

Returning to the current embodiment shown in FIGS. 2 and 3, the channels 50 there can extend along the body 20 and can be defined by the first housing 24 and the second housing 25. In particular, each channel can be comprised of a first channel part and a second channel part associated with the respective first housing and second housing. For example, the first channel 51 can include a first channel part 51A and a second channel part 51B or channel continuation. The first channel part 51A can be defined by the first housing 24 and the second channel part 51B can be defined by the second housing 25. As mentioned above, the first channel 51 can include a first sidewall 52A and a second sidewall 52B, and optionally a bottom 54. The first channel part 51A can include a portion of the first sidewall 52A and second sidewall 52B and bottom 54. The second channel part 51B can include another portion or continuation of this first sidewall 52A, second sidewall 52B and bottom 54. Each of these respective portions, formed by the respective first channel part and second channel part, can be aligned with and flush to the corresponding structure on the other housing part. For example, the sidewall in the first housing part aligns with and is flush with the second sidewall of the second housing part. Optionally, this alignment can be achieved by clocking the threaded connection 26 that joins the first housing 24 to the second housing 25. This threaded connection can be a clocked, threaded connection which includes threads that engage one another such that the first channel part and second channel part as well as the respective adjacent buttresses are perfectly aligned with one another. Accordingly, the channels and buttresses are continuous and aligned from the distal end 22 to the proximal end 21. The respective surfaces can be aligned with, flush and/or parallel with one another. Optionally, the threaded connection includes a Higbee thread.

As shown in FIGS. 1 and 2, the first housing 24 can include a first intermediate edge 24E and the second housing 25 can include a second intermediate edge 26E. These edges are portions of the respective housings that can engage one another when the threaded portion 26 is satisfactorily tightened and optionally the first and second channel parts are aligned with one another. The first housing 24 also can include a first front edge 24F, while the second housing can include a rear edge 26R. The first edge 24F can be located at the distal end 22 and the rear edge 26R can be located at the proximal end 21 of the body 20.

As shown in FIG. 3, the channels 50 can be disposed radially outward from the threaded connection 26. As an example, each of the channels as mentioned above can include a bottom 54. This bottom can be in an outward spaced relationship relative to the male and female threads and their components. For example, the female threads 26F and male threads 26M can be closer to the bottom 54 of the channel than to the exterior surface 20E of the body taken along a radial ray extending away from the longitudinal axis LA. Where the second housing includes the threads 26M, that portion of the second housing, which is inside the first housing, does not define a portion of the channel. Instead, that portion of the second housing is threaded and has a smaller exterior diameter DE than the diameter DB or the distance DC which corresponds to the distance between bottoms of channels diametrically opposite one another across the longitudinal axis LA.

Optionally, the channels 50 can be disposed adjacent a tool land 29B of the body 20. As shown, the tool land 29B can be disposed on the second housing 25 so that the second housing can be unthreaded from the first housing 24 at the threaded connection. The tool land 29B can overlap a portion of one or more of the channels 50. This tool land however is generally distal from the channels and does not necessarily form a portion of those channels along an evacuation path or flow path EP. Optionally, the land 29B can be transverse to the channels, which generally can be parallel to the longitudinal axis LA.

A method of using the current embodiments will now be described in connection with cleaning equipment. While not being limited thereto, the current embodiment is shown in connection with cleaning a heat exchanger that is used in an oil refining process. The heat exchanger includes an array of tubes, for example, tubes 6 and 7, joined with the faceplate 5. The tube can include a buildup, deposit or coating of material M on the interior sidewall 9 of the tube 6. A user can manually grasp a portion of the nozzle 10 and/or lance 8 and insert the head 30 and body 20 into the proximal end 1 of the tube 6, past the faceplate 5 of the exchanger. The user can advance the nozzle past the faceplate such that the head, body and lance are within the tube. The user can actuate a high pressure liquid pump to pump the liquid at high pressure through the lance 8 into the internal conduit 23 of the body 20, through the internal conduit 43 of the shaft 40 and through the head 30. As a result, this liquid under high pressure exits the respective jets.

Optionally, liquid is ejected from the head through the rotator jet 32 into the tube 6, a pressure of optionally at least 1000 psi, at least 2500 psi, at least 5000 psi, at least 10,000 psi or at least 20,000 psi. When the high pressure liquid exits the rotator jet 32, it creates a jet stream. Because the rotator jet is at an angle relative to the head and longitudinal axis, that jet stream of liquid causes the head 30 to rotate in direction R about the axis of rotation or generally about the longitudinal axis LA of the nozzle. The cutter jets 34 cut into material M on the sidewall 9 of the tube to remove it or turn it into particulate or small pieces, generally in the form of removed material MP. The thruster jets 33 provide a forward force to assist in moving the nozzle forward toward the distal end 2.

As the nozzle 10 is advanced through the tube 6, which again can be a cylindrical exchanger tube, it moves away from the first or proximal end 1 and toward the second or distal end 2. When the liquid is expelled from the jets, a portion of that liquid flows through the channels 50 rearward. This liquid travels along the evacuation path or flow path EP through the channels 50 and moves rearward of the nozzle 10, toward the proximal end 1. As the portion of liquid travels through the channel 50, and engages the respective first and second channel parts, the portion of liquid also contacts the first and second sidewalls and bottom of the respective channels. Portions of the liquid also can flow along the second path EPS in the gap G as described below.

As it continues to flow rearward, away from the distal end 22 of the nozzle toward the proximal end 1 of the tube, the portion of liquid can exit the heat exchanger tube at the tube first or proximal end 1. Another portion of the liquid can be propelled forward of the head by the jets. This portion of liquid can continue forward of the nozzle and exit the tube at the tube second or distal end 2. As the liquid is thrust against the sidewalls, and material M on the sidewall 9 of the tube 6 is removed to form loose, removed material MP that can move with the flowing liquid in various paths. This removed material thus can follow similar paths as the liquid. For example, the removed can travel along the evacuation path EP, generally through the channels, rearward of the nozzle. The removed material also can travel forward of the nozzle 10.

Referring to FIG. 3, the evacuation path or flow path EP can extend through the channels 50. When the total area or volume of the channels is added up, it can be seen that the effective conduit formed by the elongated channels, collectively can be rather large and thereby can release and evacuate much liquid and material. FIG. 3 also illustrates a secondary flow space or gap G that is disposed between the exterior surface 20E of the body 20 and the sidewall 9 of the tube 6. Within this gap G, which extends along the nozzle, generally outward from the respective buttresses 56, between the buttresses 56 and the sidewall 9, liquid can flow under high pressure along the second path EPS. Optionally, this second path EPS can be in liquid communication with the evacuation path EP of the channels. Thus, the liquid flowing in and along each of these paths can intermingle, sometimes crossing from one path to the other, with the liquid in both paths generally flowing from the distal end 22 toward the proximal end 21 of the nozzle, along the body.

As the nozzle is advanced in the tube 6, it continues to clean and remove material M from the sidewall 9. Again, the resulting removed material MP can be evacuated with a portion of the liquid in the channels 50, generally toward the proximal end 1 of the tube 6. Other removed material can be propelled forward of the nozzle and out the distal tube end 2. As the portion of the liquid flows to the channels, for example, the first channel 51, along the evacuation path EP, the portion of liquid flows past the forward edge 24F, past the first intermediate edge 24E, past the second intermediate edge 26E, and past the rear edge 26R. As it does so, the liquid flows optionally parallel to the longitudinal axis through the channel. The portion of the liquid is evacuated away from the distal end 22 of the body and generally away from the head, its respective jets and the shaft. As the liquid flows rearward, toward the proximal end 21 of the body 20 and nozzle in general, the high pressure liquid also flows in direction F1, through the internal conduits 23 and 43 in an opposite direction. The portion of the liquid also flows along the path EP which is located radially outward relative to the threaded connection 26 as well as the male portion 26M of the second housing 25. The portion of liquid that is evacuated through the channels also contacts the second housing 25 via its interaction with the second channel part 51B defined by the second housing 25. However, the portion of liquid does not engage the male threaded part 26M of the second housing because that male threaded part is disposed below and radially inward from the bottom 54 of the channel in the first channel part 51A. In some cases, where the body includes a tool land, for example, the tool land 29B, the portion of liquid flows along the evacuation path adjacent a portion of the tool land as that liquid is evacuated away from the distal end 22.

With reference to FIG. 3, a portion of the liquid evacuated through the channels 50 and generally rearward from the distal end 22 also flows at least partially through the gap G between or bounded by the exterior surface 20E and the interior surface of the sidewall 9, along the second path EPS. The amount of the portion of liquid that flows through this gap can be substantially less than the volume of liquid that flows through the channels, generally along the evacuation path EP.

With reference to FIG. 4, the nozzle 10 can be advanced axially within the elongated tube 6. As it does so, the high pressure liquid ejected from the jets in the head 30 continues to clean the material M from the sidewall. Some of that removed material MP is conveyed with the portion of the liquid that is evacuated through the channels 50, generally back toward the proximal end 1 of the tube.

In some cases, where material M becomes significantly built up on the sidewall of the tube 6, it can produce a blockage B as described above. When the nozzle 10 encounters this blockage B, the user may inadvertently forcefully push the nozzle 10 against or adjacent the blockage B, without realizing it is there. As described above, the high pressure liquid ejected from the jets in the head is projected against the blockage. This in turn, can create a back force BF against the nozzle. With the current embodiment however, as the gap between the nozzle and the blockage B decreases, a significant portion of the liquid under pressure can be evacuated by the channels operating in an evacuation mode. In particular, a portion of the liquid under that high pressure can be conveyed from the distal end 22 to the proximal end 21 of the nozzle, thereby bypassing the nozzle such that the portion of liquid is propelled rearward to the proximal end 1 of the tube. As a result, with this portion of liquid being evacuated from adjacent the nozzle and the head, pressure between the nozzle and the blockage B can be significantly decreased. Therefore, the back force BF created by the high pressure liquid against the blockage B reduces by a sufficient amount. In effect, the evacuation of the portion of liquid through the channels prevents and/or impairs hydraulicing or bulleting of the nozzle in the tube. This in turn reduces the likelihood that the nozzle will shoot out from the tube under this hydraulicing action. Optionally, enough of the portion of liquid is evacuated through the channels so as to impair propulsion of the nozzle toward the faceplate 5 of the heat exchanger within which the tube is disposed, generally toward a location where a user engages the lance 8 joined with the nozzle 10.

When the nozzle engages a blockage, the user can observe an increase in the portion of liquid evacuated through the proximal end 1 of the tube and/or can feel the blockage B in the tube. Upon such observations or discovery of a blockage, and a potential hydraulicing situation, the user can remove the nozzle from the tube, with the nozzle again passing the faceplate 5 a direction away from the distal end 2 of the tube. At that point, the user can take appropriate action with regard to the blockage and subsequent cleaning.

After a first tube 6 is cleaned, the nozzle 10 can be removed from that tube and inserted into a second tube 7 in the array of the heat exchanger. The nozzle 10 can be advanced into the second tube 7. As it is advanced, the head 30 rotates relative to the body 20 as described above. Certain portions of the liquid are evacuated through the channels 50. If a blockage is encountered in the second tube 7, the channels again can impair and/or prevent hydraulicing of the nozzle. If no significant blockage is encountered, the nozzle can clean the sidewall of the tube. The nozzle is advanced in the second tube 7 in such a case until nozzle exits the distal end of that tube. After the second tube is clean, the nozzle and lance can be retracted back toward the user, out of that second tube. The process can be repeated for multiple additional tubes in the tube array of the heat exchanger until the heat exchanger is satisfactorily cleaned.

Optionally, the current embodiments with grooves defined by the outer diameter (OD) of the nozzle and its components can allow waste, water, liquids and removed material to evacuate under pressure. This can provide for more efficient cleaning as the jets are not fighting residual waste and/or water. The construction can further reduce and/or abate risk of hydraulicing as the waste and water has a path of evacuation between the inner diameter (ID) of the tube and OD of the nozzle. This can allow for pressure drop between any blockage in the tube and the nozzle thereby reducing back thrust or hydraulicing. In some applications, because the nozzle has reduced risk of hydraulicing, it can be possible to increase the OD selection of the nozzle. With a non-grooved nozzle, an operator ensures there is adequate clearance between the ID of the tube and the OD of the nozzle to prevent hydraulicing. For example, a tube with an ID of 27 mm would generally have a 13 mm nozzle installed for cleaning. This means approximately 6 mm per side radial clearance for evacuation of waste and water. An issue can be that the use of a 13 mm nozzle in a 27 mm tube results in the water jets are at least 6 mm from the ID of the tube, so the pressure of the liquid is not as directly on the cleaned surface. Using the nozzle having grooves of the current embodiments, an operator can for example select a 24 mm nozzle OD for use in a 27 mm ID tube, which still allows for waste and water to pass around the OD through the grooves. With this, the radial clearance can be 1.5 mm and the nozzle jets are immediately adjacent the surfaces of the tube on the ID of the tube for cleaning.

Figure 8:
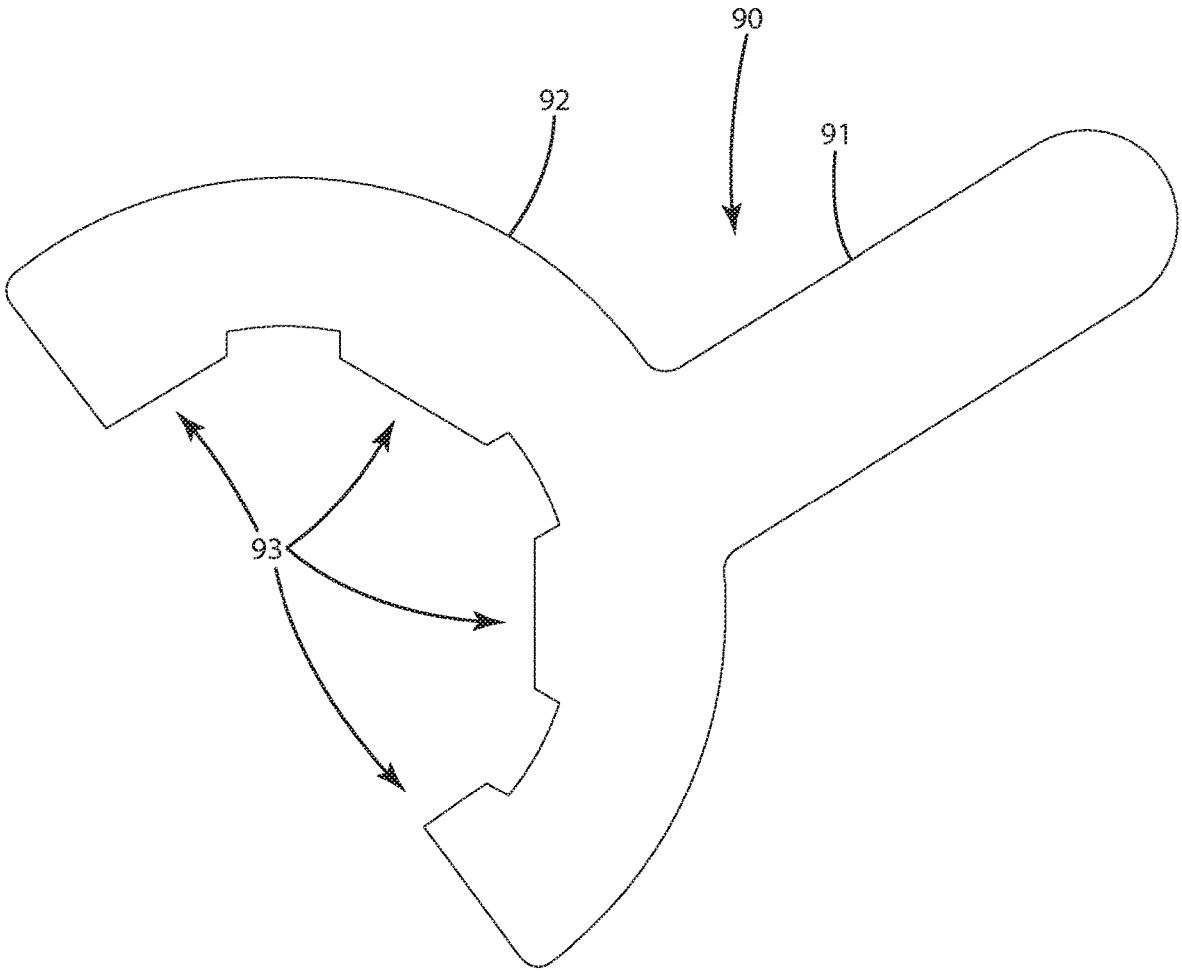
FIG. 8 is a tool configured to engage portions of the nozzle to rotate the same relative to a lance or relative to other portions of the nozzle to disassemble or assemble the same.

With reference to FIG. 8, a special tool can be configured to engage the nozzle and its components for disassembly. This tool 90 can include a handle 91 and an engagement part 92. The engagement part 92 can include teeth 93 that are configured to fit between the buttresses 56 of the body 20 of the nozzle. The teeth also can fit within the channels 50 of the body. One or two such tools can be used to rotate the first and second housings relative to one another, the lance or the head in assembly or disassembly of these components.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation.

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

The embodiments of the invention in which an exclusive property or privilege is claimed are defined as follows:

1. A method of cleaning equipment, the method comprising:

providing a blasting nozzle including a body having a proximal end and a distal end, a first housing part and a second housing part, a head disposed adjacent the distal end and rotatably mounted relative to the body, the head including a jet, the body defining a plurality of longitudinal channels extending from the distal end toward the proximal end, the plurality of longitudinal channels being defined in a first exterior surface of the first housing part and a second exterior surface of the second housing part, each of the plurality of channels being separated from an adjacent channel by a respective longitudinal buttress;

advancing the nozzle axially within an elongated tube;

ejecting a liquid from the head through the jet into the tube at a pressure of at least 1000 psi to thereby rotate the head relative to the body about a longitudinal axis of rotation; and conveying a portion of the liquid from the distal end toward the proximal end through the plurality of channels while the head rotates to evacuate the portion of liquid away from the head, wherein the evacuation of the portion of liquid through the plurality of channels at least one of prevents and impairs hydraulicing of the nozzle in the tube when the nozzle encounters a blockage within the tube.

2. The method of claim 1, wherein the plurality of channels includes a first channel defined in the first exterior of the first housing rearward from the distal end and extending toward a first intermediate edge, and a second channel defined in the second exterior of the second housing and extending rearward from a second intermediate edge toward the proximal end, wherein the portion of liquid flows through the first channel, past the first intermediate edge, past the second intermediate edge, and toward the proximal end as the portion of liquid is evacuated away from the distal end.

3. The method of claim 2, wherein the first housing is connected to the second housing via a threaded connection adjacent the first intermediate edge, wherein the portion of liquid flows along a path that is radially outwardly located relative to the threaded connection.

4. The method of claim 1, wherein the head is joined with a support shaft that extends into the body, wherein the support shaft rotates in the first housing during the advancing step.

5. A method of cleaning equipment, the method comprising:

providing a blasting nozzle including a body having a proximal end and a distal end, a first housing part and a second housing part, a head disposed adjacent the distal end and rotatably mounted relative to the body, the head including a jet, the body defining a plurality of longitudinal channels extending from the distal end toward the proximal end;

advancing the nozzle axially within an elongated tube;

ejecting a liquid from the head through the jet into the tube at a pressure of at least 1000 psi to thereby rotate the head relative to the body about a longitudinal axis of rotation; and conveying a portion of the liquid from the distal end toward the proximal end through the plurality of channels while the head rotates to evacuate the portion of liquid away from the head, wherein the evacuation of the portion of liquid through the plurality of channels at least one of prevents and impairs hydraulicing of the nozzle in the tube when the nozzle encounters a blockage within the tube, wherein the second housing includes a tool land, wherein the portion of liquid flows adjacent a portion of the tool land as the portion of liquid is evacuated away from the distal end.

6. A method of cleaning equipment, the method comprising:

providing a blasting nozzle including a body having a proximal end and a distal end, a first housing part and a second housing part, a head disposed adjacent the distal end and rotatably mounted relative to the body, the head including a jet, the body defining a plurality of longitudinal channels extending from the distal end toward the proximal end;

advancing the nozzle axially within an elongated tube;

ejecting a liquid from the head through the jet into the tube at a pressure of at least 1000 psi to thereby rotate the head relative to the body about a longitudinal axis of rotation; and conveying a portion of the liquid from the distal end toward the proximal end through the plurality of channels while the head rotates to evacuate the portion of liquid away from the head, wherein the evacuation of the portion of liquid through the plurality of channels at least one of prevents and impairs hydraulicing of the nozzle in the tube when the nozzle encounters a blockage within the tube, wherein the plurality of channels includes a first channel comprising a first channel sidewall and an opposing second channel sidewall, wherein the first channel sidewall and second channel sidewall transition to a first exterior surface of the body, wherein the first exterior is substantially cylindrical, wherein the first exterior is adjacent a tube sidewall of the elongated tube during the advancing, with a gap formed therebetween, wherein the portion of liquid evacuated through the plurality of channels flows at least partially through the gap.

7. A method of cleaning equipment, the method comprising:

providing a blasting nozzle including a body having a proximal end and a distal end, a first housing part and a second housing part, a head disposed adjacent the distal end and rotatably mounted relative to the body, the head including a jet, the body defining a plurality of longitudinal channels extending from the distal end toward the proximal end;

advancing the nozzle axially within an elongated tube;

ejecting a liquid from the head through the jet into the tube at a pressure of at least 1000 psi to thereby rotate the head relative to the body about a longitudinal axis of rotation;

conveying a portion of the liquid from the distal end toward the proximal end through the plurality of channels while the head rotates to evacuate the portion of liquid away from the head; and evacuating material removed from a sidewall of the elongated tube through the plurality of channels with the portion of liquid such that the material travels substantially parallel to a longitudinal axis of the nozzle, between the nozzle and the tube sidewall of the elongated tube, wherein the evacuation of the portion of liquid through the plurality of channels at least one of prevents and impairs hydraulicing of the nozzle in the tube when the nozzle encounters a blockage within the elongated tube, wherein the portion of liquid and the material flow past a first front edge of the first housing, along a channel sidewall that is substantially parallel to the longitudinal axis, past a first intermediate edge of the first housing, past a second intermediate edge of the second housing that is adjacent the first intermediate edge, and past a rear edge of the second housing during the conveying step.

8. A method of cleaning equipment, the method comprising:

providing a blasting nozzle including a body having a proximal end and a distal end, a first housing part and a second housing part, a head disposed adjacent the distal end and rotatably mounted relative to the body, the head including a jet, the body defining a plurality of longitudinal channels extending from the distal end toward the proximal end;

advancing the nozzle axially within an elongated tube;

ejecting a liquid from the head through the jet into the tube at a pressure of at least 1000 psi to thereby rotate the head relative to the body about a longitudinal axis of rotation; and conveying a portion of the liquid from the distal end toward the proximal end through the plurality of channels while the head rotates to evacuate the portion of liquid away from the head, wherein the evacuation of the portion of liquid through the plurality of channels at least one of prevents and impairs hydraulicing of the nozzle in the tube when the nozzle encounters a blockage within the tube, wherein the first housing and second housing are joined via a threaded connection, wherein the threaded connection includes a male threaded part and a female threaded part, wherein the female threaded part defines the plurality of channels adjacent a first intermediate edge, wherein the female threaded part includes female threads on an interior portion, wherein the female threaded part includes an exterior surface that is placed adjacent a sidewall of the elongated tube during the advancing, wherein each of the plurality of channels includes a bottom, wherein the female threads are closer to the bottom than to the exterior surface.

9. A method of cleaning equipment, the method comprising:

providing a blasting nozzle including a body having a proximal end and a distal end, a first housing part and a second housing part, a head disposed adjacent the distal end and rotatably mounted relative to the body, the head including a jet, the body defining a plurality of longitudinal channels extending from the distal end toward the proximal end;

advancing the nozzle axially within an elongated tube;

ejecting a liquid from the head through the jet into the tube at a pressure of at least 1000 psi to thereby rotate the head relative to the body about a longitudinal axis of rotation;

conveying a portion of the liquid from the distal end toward the proximal end through the plurality of channels while the head rotates to evacuate the portion of liquid away from the head; and removing material from a sidewall of the elongated tube with liquid flowing through a cutter jet of the head, the cutter jet facing generally forward along a longitudinal axis of the nozzle; and thrusting the material rearward, away from the head and through the plurality of channels with liquid flowing through a thruster jet of the head, wherein the liquid exits each of the cutter jet and the thruster jet at a pressure of at least 1000 psi, wherein the evacuation of the portion of liquid through the plurality of channels at least one of prevents and impairs hydraulicing of the nozzle in the tube when the nozzle encounters a blockage within the tube.

10. The method of claim 9, wherein the elongated tube is a cylindrical heat exchanger tube, wherein during the advancing step, the nozzle moves away from a tube first end and toward a distal tube second end, wherein the portion of liquid conveyed through the plurality of channels exits rearward of the nozzle and exits the heat exchanger tube at the tube first end, wherein another portion of the liquid exits forward of the nozzle and exits the heat exchanges tube at the distal tube second end.

11. A method of cleaning equipment, the method comprising:

providing a blasting nozzle including a body having a proximal end and a distal end, an exterior, a first housing part and a second housing part, a head disposed adjacent the distal end and rotatably mounted relative to the body, the head including a jet, the body defining a plurality of longitudinal channels extending from the distal end toward the proximal end, each longitudinal channel being separated from an adjacent channel by an elongated buttress that extends parallel to a longitudinal axis of rotation;

ejecting a liquid from the head through the jet into an elongated tube to thereby rotate the head relative to the body about the longitudinal axis of rotation; and conveying a portion of the liquid through the plurality of longitudinal channels while the head rotates to evacuate the portion of liquid away from the head, wherein the evacuation of the portion of liquid through the plurality of longitudinal channels at least one of prevents and impairs hydraulicing of the nozzle in the tube when the nozzle encounters a blockage within the elongated tube.

12. A method of cleaning equipment, the method comprising:

providing a blasting nozzle including a body having a proximal end and a distal end, a first housing part and a second housing part, a head disposed adjacent the distal end and rotatably mounted relative to the body, the head including a jet, the body defining a plurality of longitudinal channels extending from the distal end toward the proximal end;

ejecting a liquid from the head through the jet into an elongated tube to thereby rotate the head relative to the body about a longitudinal axis of rotation;

conveying a portion of the liquid through the plurality of longitudinal channels while the head rotates to evacuate the portion of liquid away from the head, wherein the evacuation of the portion of liquid through the plurality of longitudinal channels at least one of prevents and impairs hydraulicing of the nozzle in the tube when the nozzle encounters a blockage within the elongated tube, wherein the elongated tube is a cylindrical heat exchanger tube, wherein the nozzle moves away from a tube first end and toward a distal tube second end, wherein the portion of liquid conveyed through the plurality of channels exits rearward of the nozzle and exits the heat exchanger tube at the tube first end, wherein another portion of the liquid exits forward of the nozzle and exits the heat exchanger tube at the distal tube second end.

13. A method of cleaning equipment, the method comprising:

providing a blasting nozzle including a body having a proximal end and a distal end, a first housing part and a second housing part, a head disposed adjacent the distal end and rotatably mounted relative to the body, the head including a jet, the body defining a plurality of longitudinal channels extending from the distal end toward the proximal end;

ejecting a liquid from the head through the jet into an elongated tube to thereby rotate the head relative to the body about a longitudinal axis of rotation;

conveying a portion of the liquid through the plurality of longitudinal channels while the head rotates to evacuate the portion of liquid away from the head; and evacuating a material removed from a sidewall of the elongated tube through the plurality of channels with the portion of liquid such that the material travels substantially parallel to a longitudinal axis of the nozzle, between the nozzle and the sidewall, wherein the evacuation of the portion of liquid through the plurality of longitudinal channels at least one of prevents and impairs hydraulicing of the nozzle in the tube when the nozzle encounters a blockage within the elongated tube, wherein the portion of liquid and the material flow past a first front edge of the first housing, along a channel sidewall that is substantially parallel to the longitudinal axis, and past a rear edge of the second housing during the conveying step.

* * * * *